US011672298B2

(12) United States Patent
Lowe et al.

(10) Patent No.: US 11,672,298 B2
(45) Date of Patent: Jun. 13, 2023

(54) HELMET WITH FACE CAGE PUSH CLIP

(71) Applicant: Zam Helmets Inc., Redwood Falls, CA (US)

(72) Inventors: Michael Lowe, Santa Cruz, CA (US); Whitman Kwok, Emerald Hills, CA (US); David Stoutamire, Menlo Park, CA (US)

(73) Assignee: ZAM Helmets Inc., Redwood City, CA (US)

( * ) Notice: Subject to any disclaimer, the term of this patent is extended or adjusted under 35 U.S.C. 154(b) by 154 days.

(21) Appl. No.: 17/383,665

(22) Filed: Jul. 23, 2021

(65) Prior Publication Data

US 2022/0022589 A1 Jan. 27, 2022

Related U.S. Application Data

(60) Provisional application No. 63/055,961, filed on Jul. 24, 2020.

(51) Int. Cl.
*A42B 3/20* (2006.01)

(52) U.S. Cl.
CPC ..... *A42B 3/20* (2013.01)

(58) Field of Classification Search
CPC ..... A42B 3/20; A42B 3/04
See application file for complete search history.

(56) References Cited

U.S. PATENT DOCUMENTS

| | | | | |
|---|---|---|---|---|
| 5,412,814 | A | 5/1995 | Pernicka et al. | |
| 5,555,567 | A * | 9/1996 | Corpus | A42B 3/20 2/9 |
| 7,975,319 | B2 * | 7/2011 | Moore | A42B 3/04 2/424 |
| 10,085,509 | B2 * | 10/2018 | Warmouth | A42B 3/32 |
| 10,136,692 | B2 * | 11/2018 | Ide | A42B 3/125 |
| 2016/0029733 | A1 * | 2/2016 | Kovarik | A42B 3/20 2/424 |
| 2019/0313725 | A1 * | 10/2019 | Princip | A42B 3/067 |
| 2020/0138141 | A1 | 5/2020 | Kwok et al. | |

* cited by examiner

*Primary Examiner* — Tajash D Patel
(74) *Attorney, Agent, or Firm* — Schwegman, Lundberg & Woessner, P.A.

(57) ABSTRACT

A helmet includes a helmet body and a clip coupled to the helmet body, for retaining a helmet accessory such as a face cage. The clip comprises a first clip section partly defining an aperture into which a part of the helmet accessory can be received and a second clip section located opposite the first clip section. The second clip section has a first end and a second end, the first end partly defining the aperture into which the part of the helmet accessory can be received, and the second end being coupled to the helmet body. The second clip section further includes a ramped surface that can be depressed to provide access to or from the aperture by the part of the helmet accessory. Also disclosed is a clip for retaining a helmet accessory.

20 Claims, 12 Drawing Sheets

HELMET WITH FACE CAGE PUSH CLIP

CROSS-REFERENCE TO RELATED APPLICATIONS

This patent application claims the benefit of priority to U.S. Provisional Patent Application Ser. No. 63/055,961 filed on Jul. 24, 2020, the content of which is incorporated herein by reference as if expressly set forth.

BACKGROUND

Helmets with accessories such a cages or other facial attachments that can be raised away from a user's face require a fastening mechanism to hold the cage or facial attachment in the down or closed position, Current helmets use downwardly facing J-clips mounted on the helmet body, into which an upper rear portion of the cage or attachment is received. The cage is then braced against the J-clips by one or more straps that engage a lower portion of the cage or attachment at one end, and that are clipped or latched to the helmet body at the other end.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
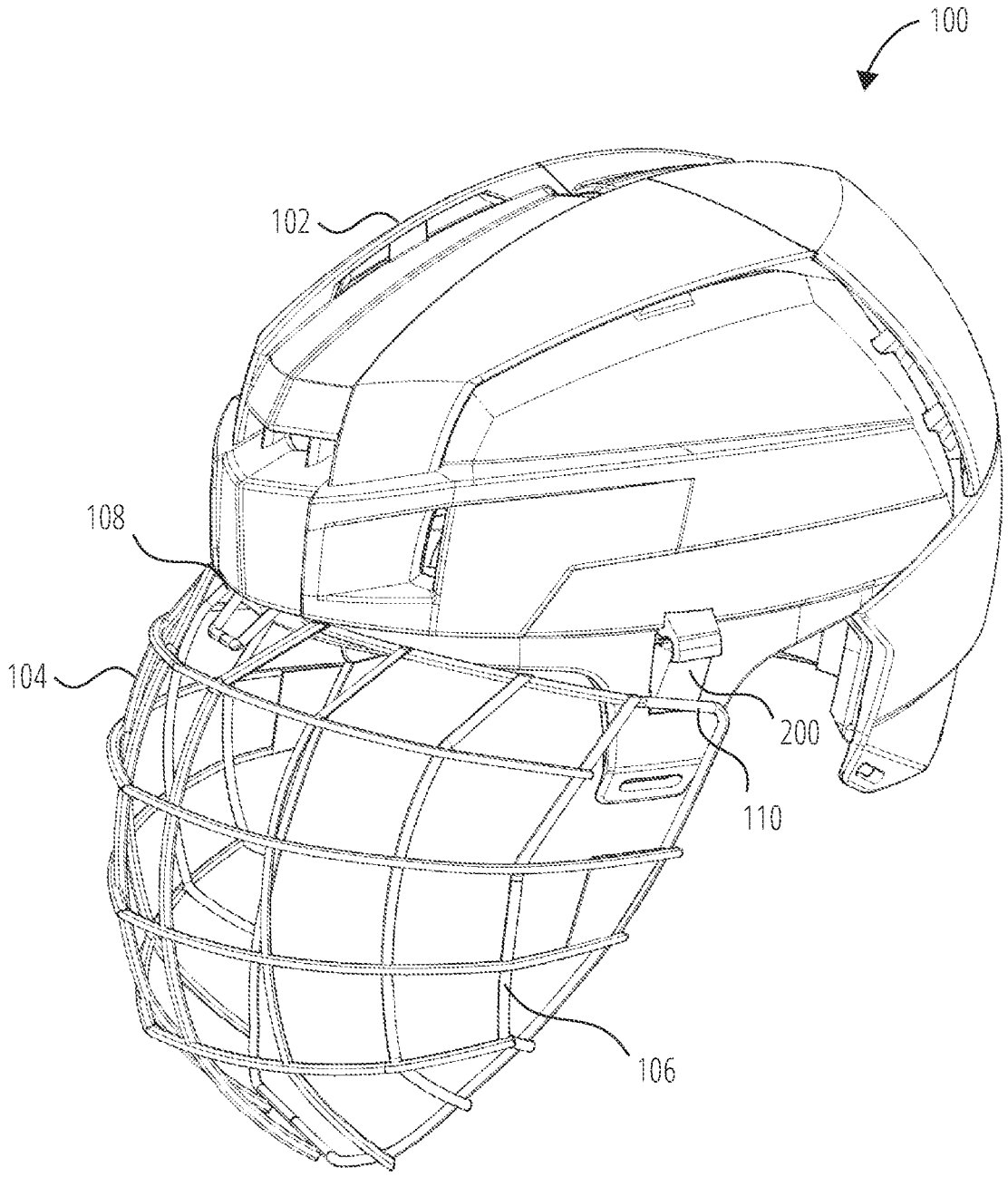
FIG. 1 illustrates a helmet with a face cage and a push clip according to one example.

The strapping mechanisms currently used may be difficult to latch and unlatch and can provide an opportunity to get caught on other players or their sticks.

In one example, a helmet includes a helmet body and a clip coupled to the helmet body for retaining a helmet accessory. The clip includes a first clip section partly defining an aperture into which a part of the helmet accessory can be received, and a second clip section located opposite the first clip section. The second clip section has a first end and a second end, the first end partly defining the aperture into which the part of a part of the helmet accessory can be received and the second end being coupled to the helmet body. The second clip section also includes a ramped surface that can be depressed to provide access to or from the aperture by the part of the helmet accessory.

The helmet may also include a leash coupling the first clip section to the second clip section to limit outward movement of the second clip section. The first clip section and the second clip section are mounted to an aperture in the helmet body. The helmet body may also include a biasing structure located in the recess in the helmet body to bias the second clip section away from the helmet body.

The helmet may also include a face cage, the face cage being the helmet accessory, and a bar of the face cage may be the part of the helmet accessory that is received in the aperture defined by the first and second clip sections. The bar of the face cage may depress the second clip section when the face cage rotates into place on the helmet body.

The first clip section may include a lip that extends towards the second clip section. The lip may overlap the ramped surface at the first end of the second clip section. The lip may also be hook-shaped to facilitate engagement between the first and second clip sections.

The first clip section may comprise a mounting portion and an arm, the arm including the ramped surface, where the arm is deflectable in use relative to the mounting portion to provide access to or from the aperture by the part of the helmet accessory. The clip may be formed at least partly of an elastomeric material that permits the part of the helmet accessory to be pulled out of the aperture between the first and second clip sections without the second clip section being depressed.

In another example, a clip for retaining a helmet accessory on a helmet body is provided, the dip including a first clip section partly defining an aperture into which a part of the helmet accessory can be received, and a second clip section opposite the first clip section and having a. first end and a second end, the first end partly defining the aperture into which the part of the helmet accessory can be received. The second end being couplable to the helmet body. The second clip section includes a ramped surface that can be depressed to provide access to or from the aperture by the part of the helmet accessory.

The first clip section may comprise a mounting portion and an arm, the arm including the ramped surface, where the arm is deflectable in use relative to the mounting portion to provide access to or from the aperture by the part of the helmet accessory. A notch may be defined in the arm, or between the arm and the mounting portion of the second clip section, to facilitate deflection of the arm relative to the mounting portion.

The clip may also include a leash coupling the first section to the second clip section to limit outward movement of the second clip section relative to the helmet body. The first clip section may also include a lip that extends towards the second clip section. The lip may overlap the ramped surface at the first end of the second clip section. The clip may be formed at least partly of an elastomeric material that permits the part of the helmet accessory to be pulled out of the aperture between the first and second clip sections without the second clip section being depressed.

In another example, a helmet includes a helmet body and a clip coupled to the helmet body, for retaining a helmet accessory. The clip includes a first clip section partly defining an aperture into which a part of the helmet accessory can be received, and a second clip section located opposite the first clip section and having a first end and a second end, the first end partly defining the aperture into which the part of the helmet accessory can be received, the second clip section including a ramped surface that can be deflected by the part of the helmet accessory to provide access to the aperture by the part of the helmet accessory.

The second clip section may be coupled to the helmet body and the ramped surface may be located on an outwardly-facing surface of the second clip section. The second clip section may be coupled to the first clip section and the ramped surface may be located on an inwardly-facing surface of the second clip section. Other technical features may be readily apparent to one skilled in the art from the following figures, descriptions, and claims.

Other technical features may be readily apparent to one skilled in the art from the following figures, descriptions, and claims.

FIG. 1 illustrates a helmet 100 with a helmet body 102, a helmet accessory such as a face cage 104 and a push clip 200 according to one example. The face cage 104 is formed of a number of interconnected bars 106 and is mounted to the helmet body 102 at a pivot point 108 that permits the face cage 104 to pivot up and away from the user's face. The face cage 104 can also pivot towards the user's face about pivot point 108 until a bar 110 at an upper rear side of the face cage 104 engages with and is held by push clip 200. Two push clips 200 are provided in this example, on either side of the helmet 100, although it will be appreciated that more or less push clips may be provided.

Figure 2:
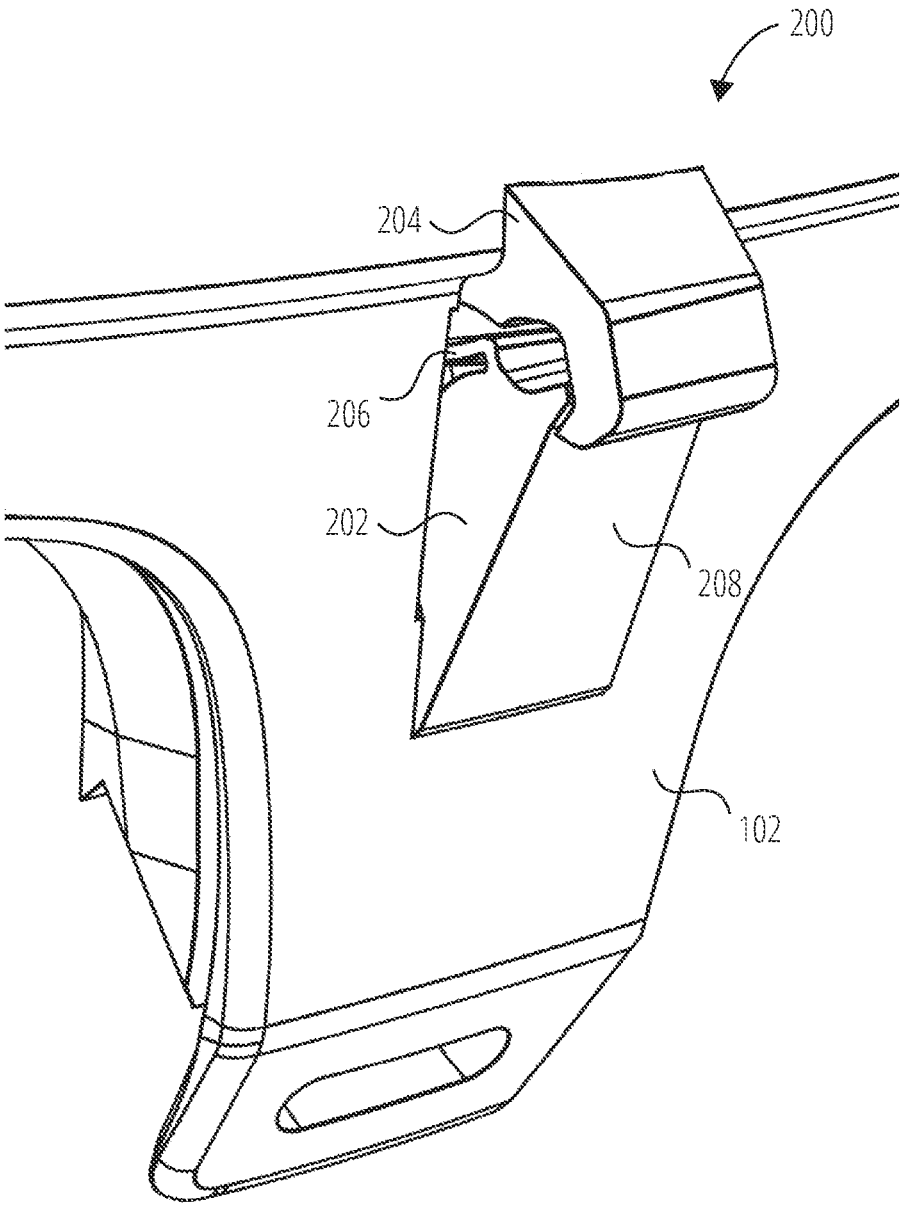
FIG. 2 is an enlarged view of the push clip of FIG. 1.

FIG. 2 is an enlarged view of the push clip 200 of FIG. 1 mounted in place on helmet body 102. according to one example. The push clip 200 comprises a lower clip 202, and upper clip 204 and a leash 206. The lower clip 202 includes a ramp 208 that is engaged by the bar 110 when the face cage 104 is rotated into the closed or down position, which depresses the lower clip 202 at least partly into the helmet body 102.

The push clip 200 is mounted over a recess 402 (see FIG. 4) or a recess 502 (see FIG. 5) defined in the helmet body 102 that permits the lower clip 202 to deflect into the helmet body 102 so that it is flush or nearly flush with the helmet body 102. This deflection allows the bar 110 to pass the lower clip 202, as the bar 110 engages the ramp 208 when the face cage 104 rotates into place in the down or closed position. When the bar 110 passes over the top end of the ramp 208, the lower clip 202 springs back into position and the bar 110 is then held in place in a slot or aperture defined between upper clip 204 and lower clip 202.

Upward movement of the rear portion of the face cage 104 is then resisted by a lower surface of the upper clip 204 and downward movement of the rear portion of the face cage 104 is resisted by an upper surface of the lower clip 202. The leash 206 prevents the lower clip 202 from rotating out and away from the helmet body 102 in response to downward forces that might be applied to lower clip 202 by bar 110. The face cage 104 can be released from the push clips 200 by the user pushing down on ramp 208 to deflect the lower clip 202 into the recess, allowing the bar 110 to move downward over the lower clip 202. The ramp 208 may have indents, textures or other features to help the user locate where best to push against the lower clip 202 to release the face cage 104, The upper clip 204, lower clip 202 and leash 206 can be manufactured as a single part or can comprise individual components bonded or assembled to each other or to the helmet body to perform the function of the push clip 200. In one example the lower push clip 200 is made of an elastomer such as thermoplastic polyurethane, however other materials may be used for one or more parts of the push clip 200 provided they have the required flexibility, shock absorption and durability required for the push clip 200 or part thereof.

The upper clip 204 can be made of virtually any material including but not limited to metal, plastic, carbon fiber or a composite. Materials with a higher modulus of elasticity or a. lower tensile strength will require a thicker, more robust part, to support the stresses resulting from impacts to the face cage 104. The lower clip 202 can be made of any material that is stiff enough to secure the face cage 104 while flexible enough to bend into the helmet recess. Alternatively, the lower clip 202 can be provided with a mechanical pivot or hinge to permit its rotation into the helmet recess. The lower clip 202 replaces or supplements the straps to retain the face cage 104 and to prevent the accidental release of the face cage 104 in the case of impacts or other forces experienced thereby.

The leash 206 is made of a flexible and durable material with a modulus of elasticity between 10-700% to prevent tearing or material fatigue. As mentioned, the primary purpose of the leash 206 is to prevent the lower clip 202 from pulling too far away from the helmet body 102, possibly resulting in an accidental release of the face cage 104 or a malfunction of the push clip 200 if the lower clip 202 moves completely past the upper clip 204. The leash 206 may also have a secondary purpose as a spring to alter or supplement the force required to push the lower clip 202 into the recess 402 or recess 502.

Figure 3A:
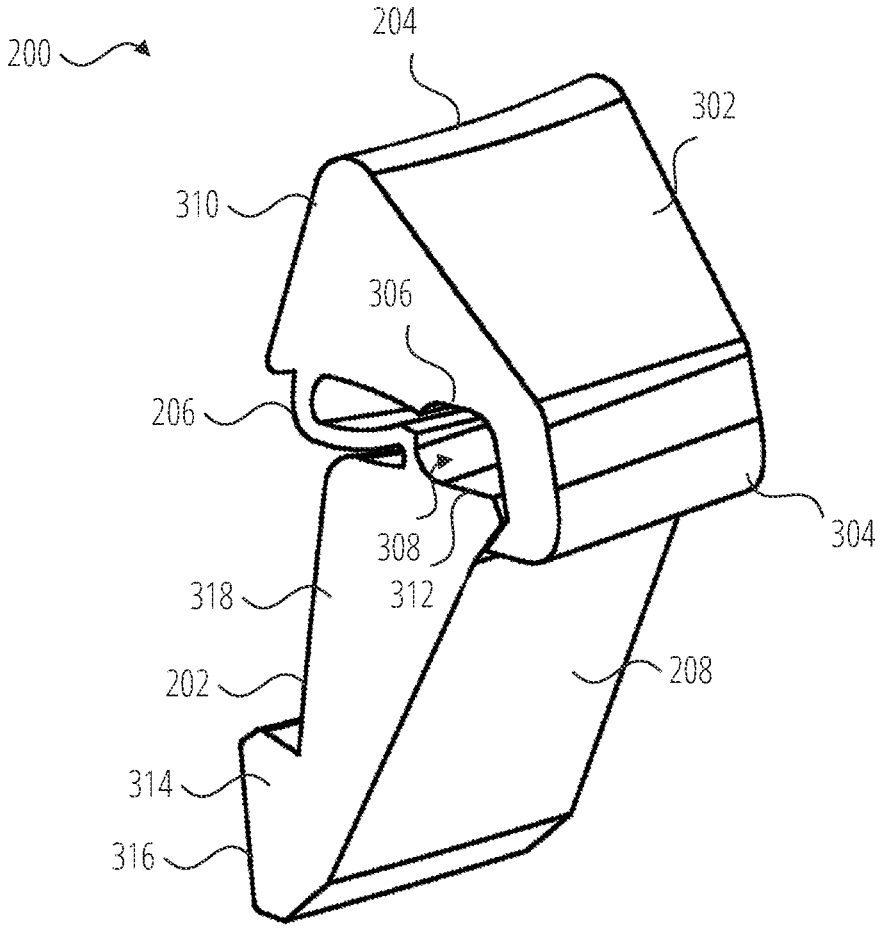
FIG. 3A, FIG. 3B and FIG. 3C illustrate the push clip 200 of FIG. 1 and 2 in more detail.
Figure 3B:
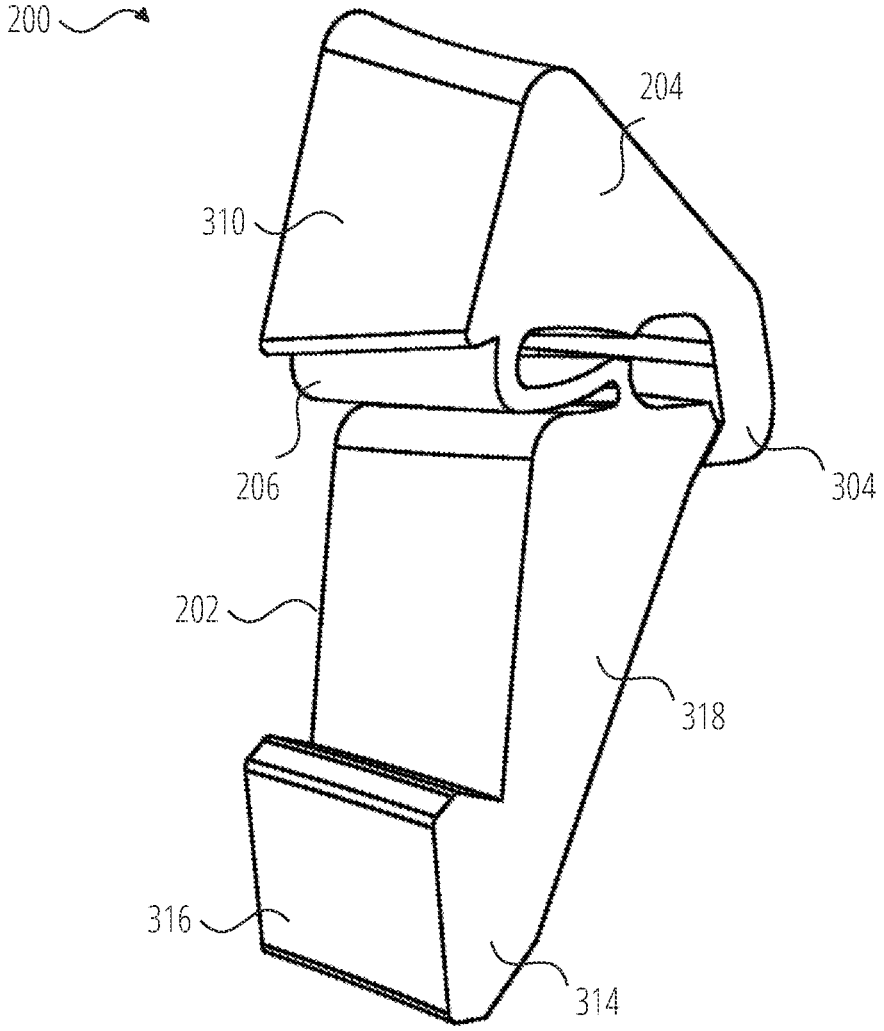
Figure 3C:
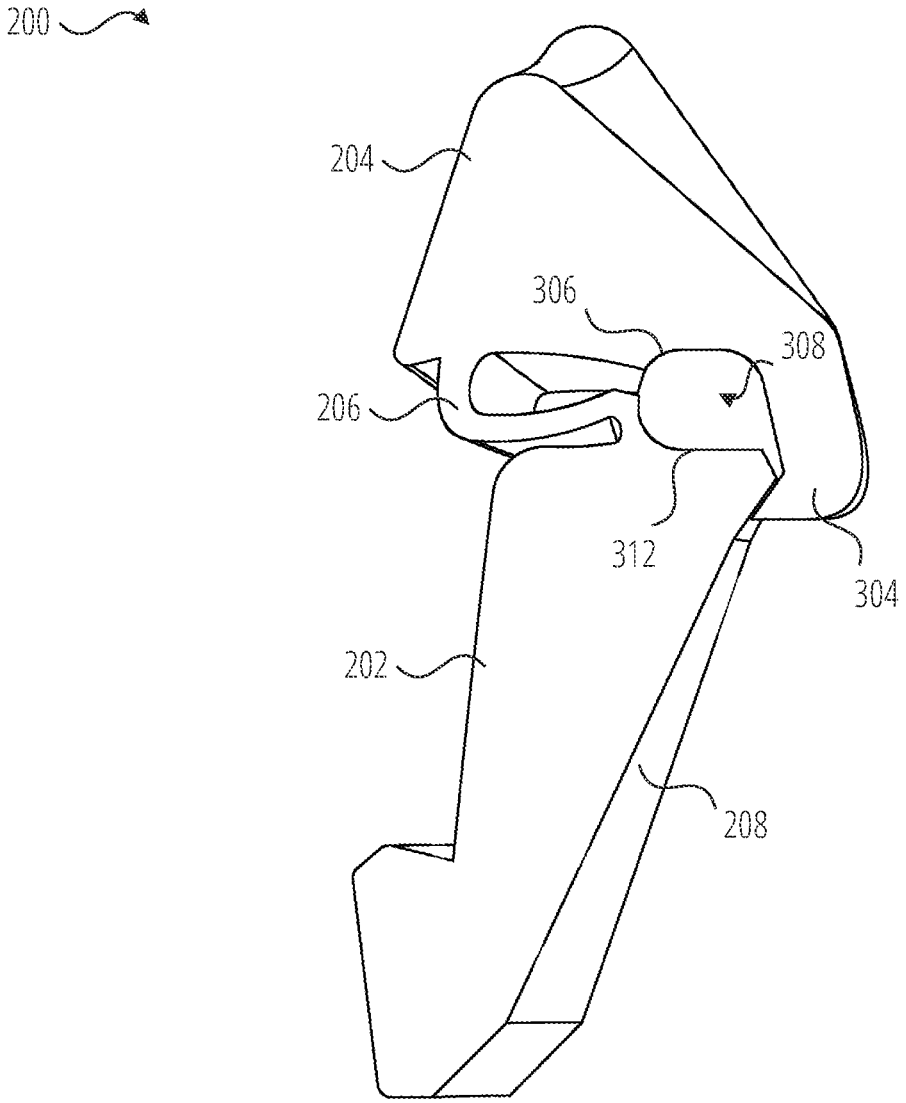

FIG. 3A, FIG. 3B and FIG. 3C illustrate the push clip 200 of FIG. 1 and FIG. 2 in more detail. FIG. 3A is a front perspective view of the push clip 200, FIG. 3B is a front perspective view of the push clip 200 showing the side of the push clip 200 that is received by the recess 402/502, and FIG. 3C is a front view of the push clip 200.

As can be seen from the figures, upper clip 204 includes a generally triangular portion 302 including a lower surface 306 that, together with an upper surface 312 of the lower clip 202, defines an aperture 308 into which the bar 110 can be received to hold the face cage 104 in place on the helmet body 102. The triangular portion 302 includes a mounting surface 310 that engages with a corresponding surface in the helmet as discussed below with reference to FIG. 4 and. FIG. 5. As mentioned below, the triangular portion 302 is bonded or affixed in another way to the helmet body 102.

The lower clip 202 includes a mounting portion 314 and an arm 318. Mounting portion 314 includes a mounting surface 316 that engages with a corresponding surface in the helmet as discussed below with reference to FIG. 4 and FIG. 5. The arm 318, which is narrower at its base where it is coupled to the mounting portion 314, can deflect towards the helmet body 102 when forces are applied to the ramp 208 as discussed above. As mentioned below, the mounting portion 314 is bonded or affixed in another way to the helmet body 102.

The leash 206, which serves to limit outward movement of the lower clip 202, is attached to the lower clip 202. at the upper surface 312 of the arm 318, although it may be attached to or formed with the arm 318 at other suitable locations. The leash 206 is formed with or attached to the triangular portion 302 along the lower surface 306, although it will be appreciated that the leash 206 could be attached elsewhere, including to the helmet body 102 itself.

The upper clip 204 also includes a lip 304 that extends downwards from the triangular portion 302 past the upper edge of the lower clip 202. The lip 304 resists sideways movement of the bar 110 out of the aperture 308 away from the helmet 100, and supports the lower clip 202 along the upper edge of the ramp 208 The lip as a stop to resist movement of the arm 318 and/or the bar 110 away from the helmet 100 in response to any downward forces exerted by the bar 110 on the upper surface 312 of the lower clip 202. The lip 304 can be seen to overlap the ramp 208 at its upper edge to engage the lower clip 202 when the lower clip 202 is not depressed or when the lower clip 202. moves further away from the helmet body 102 under the influence of forces transmitted from the bar 110.

The lip 304 may also be hook-shaped as shown to facilitate positive engagement between the lip 304 and the upper edge of the ramp 208, with a surface that is opposed to but generally parallel to the upper edge of the ramp 208. The lip 304 and the upper edge of the lower clip 202 at the top of the ramp 208 are however sufficiently compliant to permit the user to, with sufficient force, pull the face cage 104 up and away from the helmet body 102 such that the bar 110 pulls out of the aperture 308 between the lip 304 and the arm 318. This provides an alternative to depressing the arm 318 when opening the face cage 104.

Figure 4:
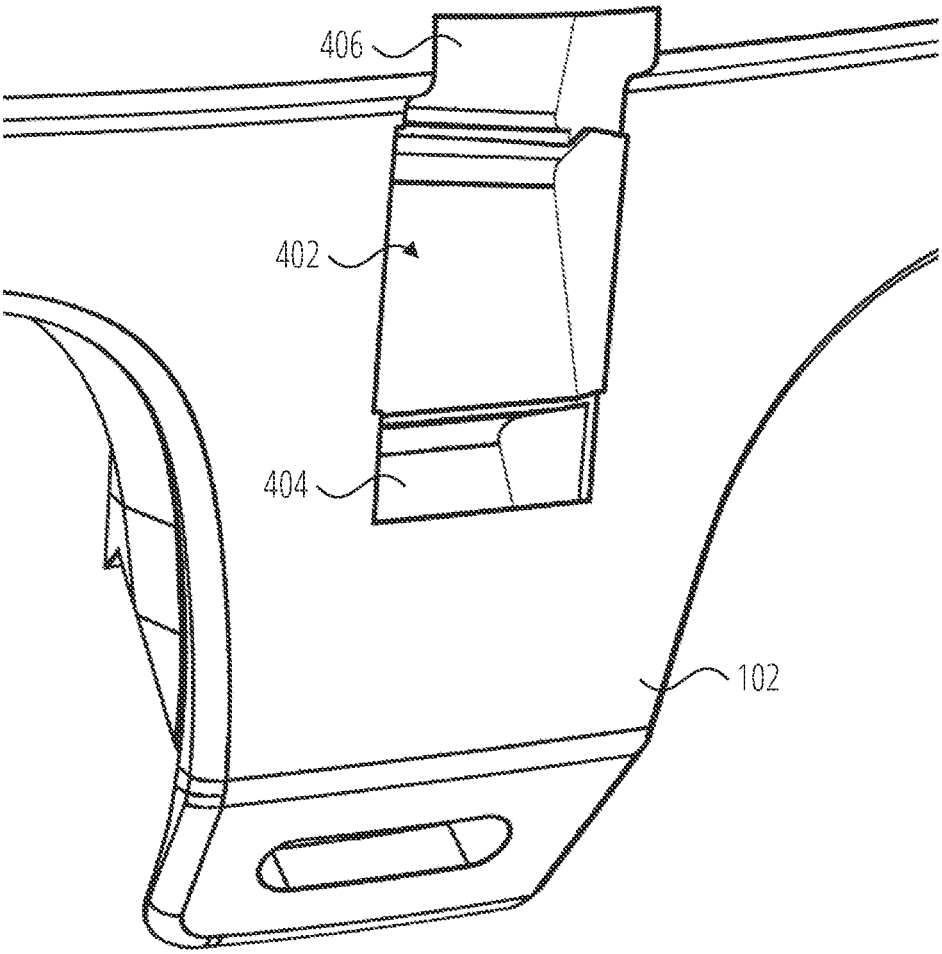
FIG. 4 illustrates a recess formed in the body of the helmet of FIG. 1, for receiving the push clip according to one example.
Figure 5:
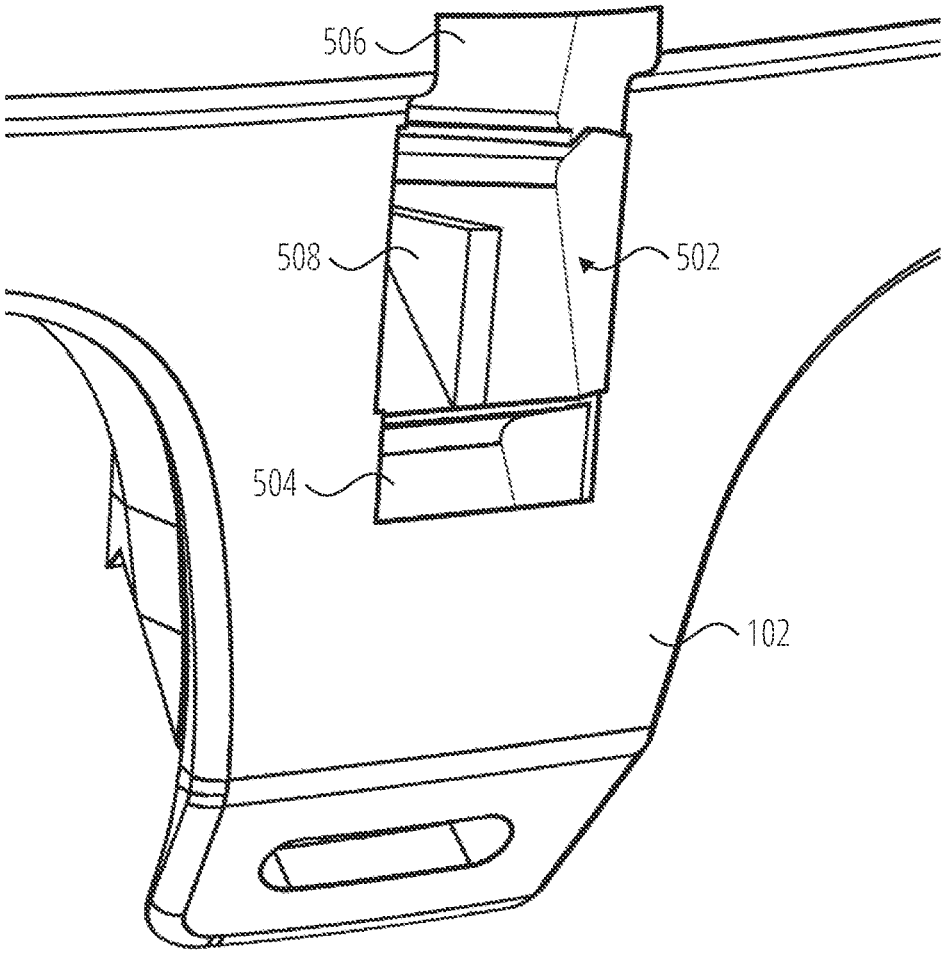
FIG. 5 illustrates a recess formed in the body of the helmet of FIG. 1, for receiving the push clip according to another example.

FIG. 4 illustrates a recess 402 formed in the helmet body 102 for receiving the push clip 200 according to one example. The recess 402 is sized and shaped to receive the upper clip 204 and lower clip 202 therein. The recess 402 includes a lower mounting surface 404 against which the mounting surface 316 of the lower clip 202 is received and an upper mounting surface 406 against which the mounting surface 310 of the upper clip 204 is received. The push clip 200 in one example is bonded to the helmet body 102 in the recess 402 against upper lower mounting surface 404 and lower mounting surface 404. However other approaches may be used, including using fasteners, screws or clips or even an appropriately tight press-fit.

FIG. 5 illustrates a recess 502 formed in the helmet body 102 for receiving the push clip 200 according to another example. As before, the recess 502 is sized and shaped to receive the upper clip 204 and lower clip 202 therein. The recess 502 includes a lower mounting surface 504 against which the mounting surface 316 of the lower clip 202 is received and an upper mounting surface 506 against which the mounting surface 310 of the upper clip 204 is received. The push clip 200 in one example is bonded to the helmet body 102 in the recess 502 against upper mounting surface 506 and lower mounting surface 504. However other approaches may be used, including using fasteners, screws or clips or even an appropriately tight press-fit.

In this example, the recess 502 contains a biasing structure such as a flexible rib 508 that acts as spring to push or bias the arm 318 of the lower clip 202 out of the recess 502. The biasing structure further facilitates the locking of the bar 110 of the face cage 104 in place in the aperture 308, as well as to facilitating the return of the arm 318 after being depressed by the bar 110 or by the user of the helmet 100. The recess 502 may include any number of other mechanical features that increase or decrease the required force to depress the lower clip 202. and cause it to spring back into place, including but not limited to a coiled spring, a flat spring and elastomeric bumpers.

A further approach is to mate the lower clip with a compliant bistable mechanism with two stable equilibrium positions separated by an unstable equilibrium position. The first or depressed stable equilibrium position provides an open mode that allows the bar 110 of the face cage 104 cage to pass the lower clip 202 in either direction and the second or released equilibrium position is one in which the face cage 104 is locked in place.

Figure 6A:
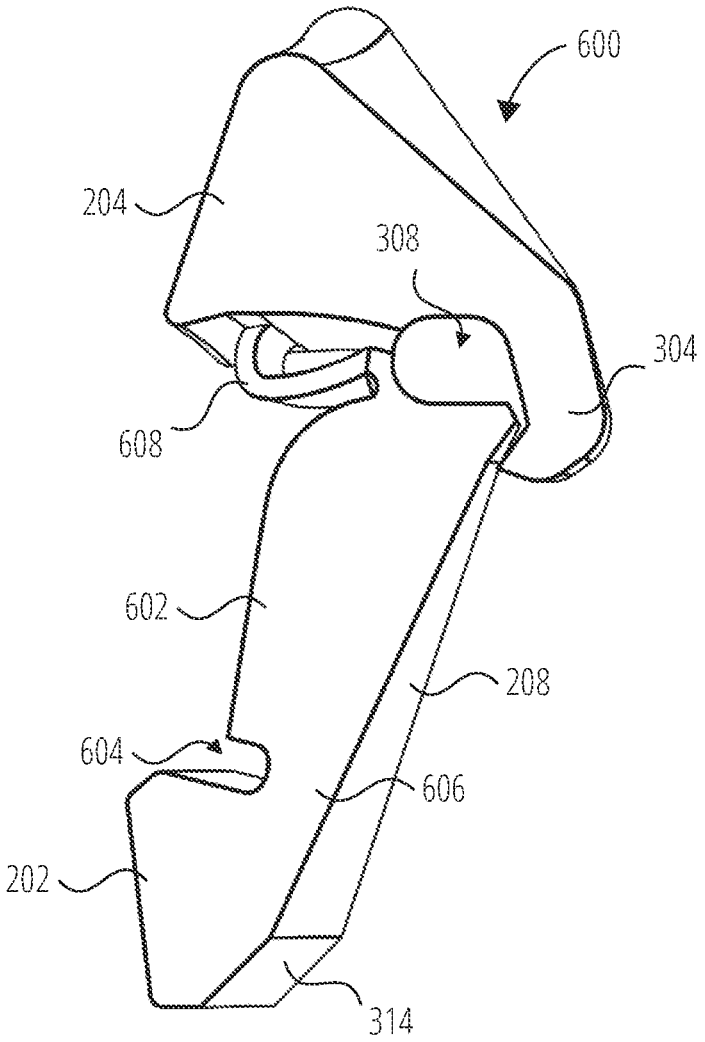
FIG. 6A, FIG. 6B and FIG. 6C illustrate a second example of a push clip for use in the helmet of FIG. 1.
Figure 6B:
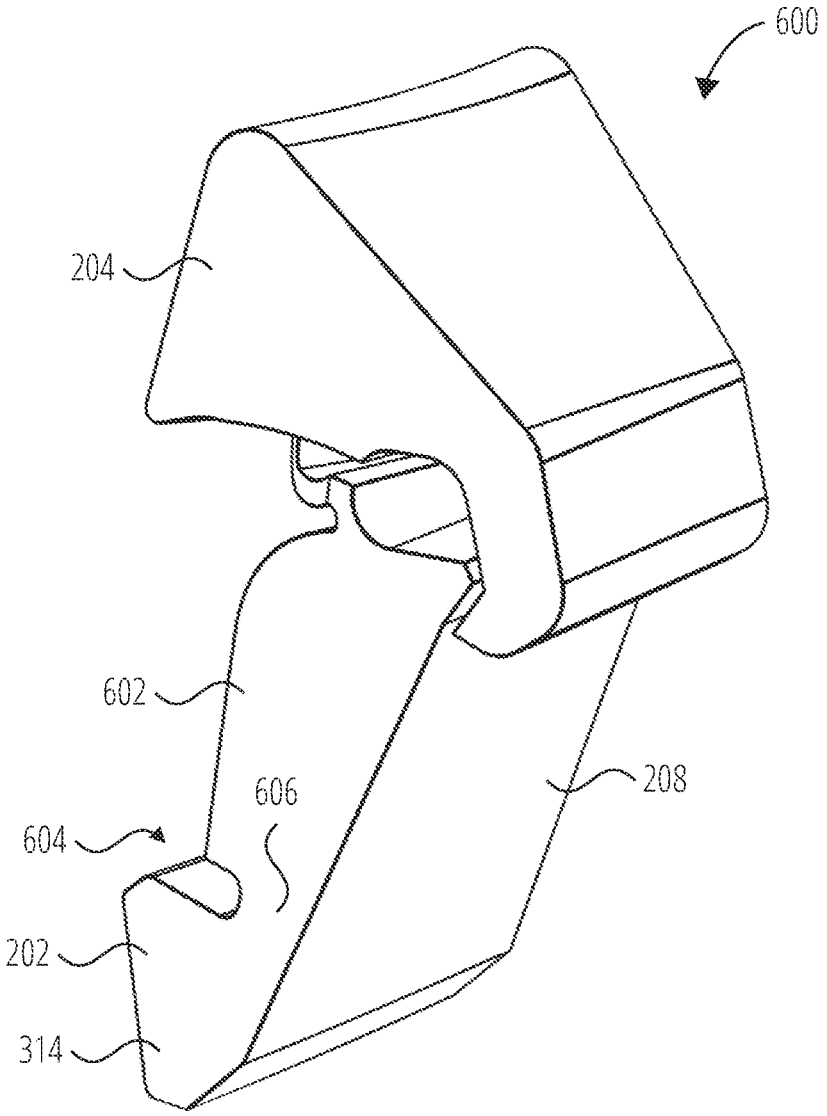
Figure 6C:
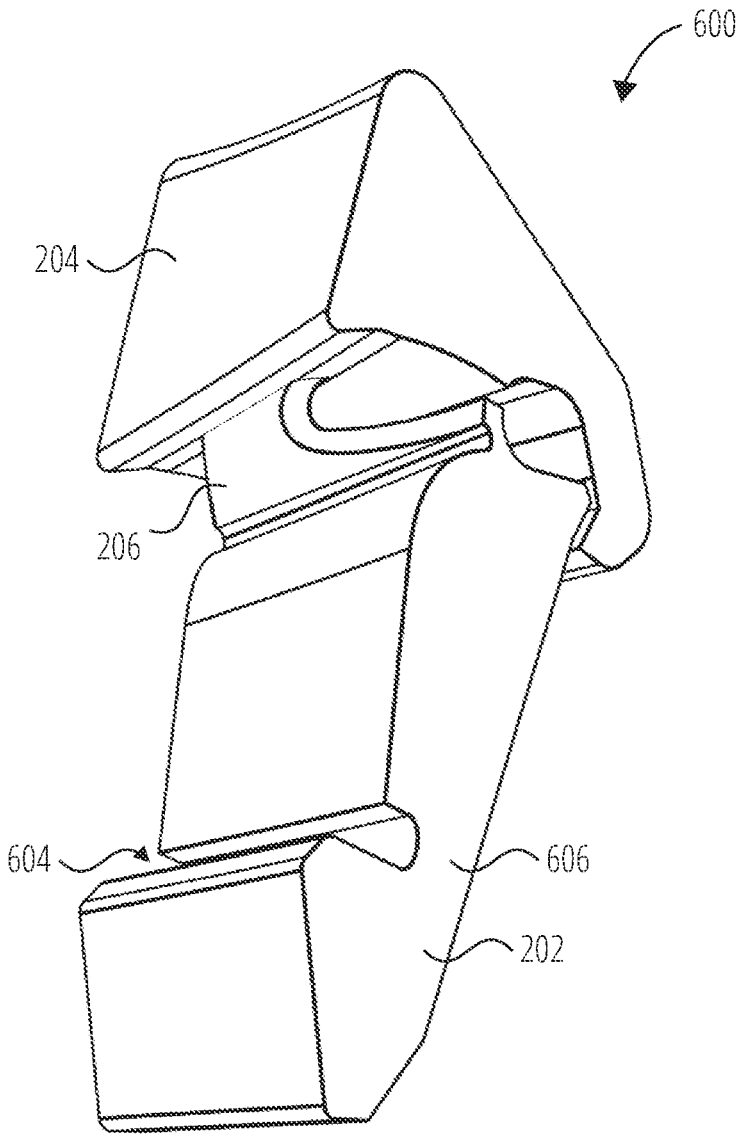

FIG. 6A, FIG. 6B and FIG. 6C illustrate a second example of a push clip for use in the helmet of FIG. 1. FIG. 6A is a front perspective view of the push clip 600, FIG. 6B is a front perspective view of the push clip 600 showing the side of the push clip 600 that is received by the recess 502, and FIG. 6C is a front view of the push clip 600.

Push clip 600 includes common elements with push clip 200, including a lower clip 202, an upper clip 204, a leash 608, a ramp 208 and an aperture 308 defined between the arm 602 and the upper clip 204 into which the bar 110 can be received to hold the face cage 104 in place on the helmet body 102.

The push dip 600 in this example is provided with a notch 604 defined between the arm 602 and the mounting portion 314 or in the arm 602. The notch 604 provides a narrower portion 606 of the lower clip 202 that serves to reduce the compliance of the lower clip under forces applied to the ramp 208 by the bar 110 or the user of the helmet. The notch and narrower portion 606 effectively serve as a hinge between the arm 602 and the mounting portion 314 to allow easier deflection of the arm 602 into the recess 402 or recess 502. Alternatively, the lower clip 202 can be provided with a mechanical pivot or hinge to permit rotation of the arm 602 relative to the mounting portion 314 into the recess 502 against a biasing structure.

Figure 7:
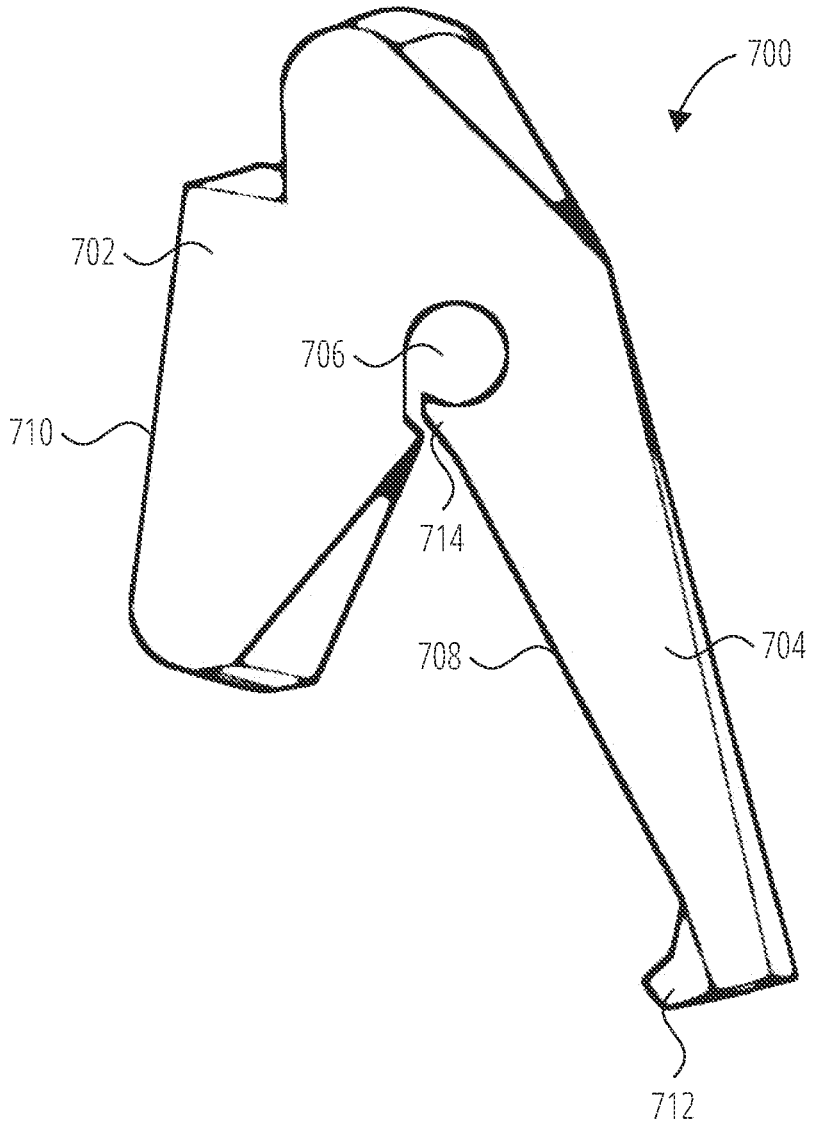
FIG. 7 illustrates a front view of a clip according to another example.
Figure 8:
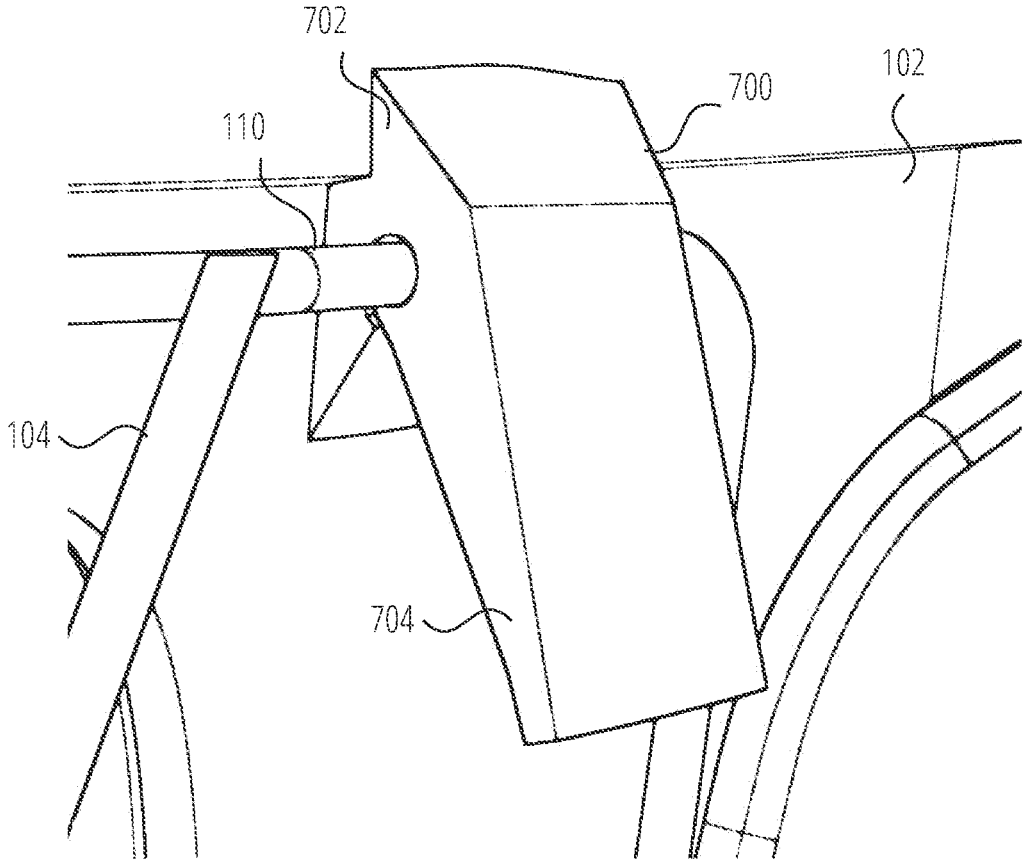
FIG. 8 illustrates a perspective view of the clip of FIG. 7 mounted to a helmet body.

FIG. 7 is a front view of a clip 700 according to another example. As can be seen from the figure, clip 700 includes a mounting portion 702 and an arm 704 formed with or coupled to the mounting portion 702. Defined between and by the arm 704 and the mounting portion 702 is an aperture 706 that can receive a bar 110 of a face cage 104 as shown in FIG. 8, to hold the face cage 104 in a closed position. The aperture 706 is open along a lower side to permit the bar 110 to enter and exit the aperture 706. The arm 704 includes an inclined or ramped surface 708, which is angled with respect to an opposing surface on the mounting portion 702 or with respect to the helmet bodies 102. A lip 714 defining an upward-facing curve or hook is located. along the lower edge of the aperture, to retain the bar 110 in place in the aperture 308.

The clip 700 in one example is formed in a single piece from an elastomeric material as described above with reference to push clip 200, but the clip 700 may be formed of more than one piece made of the same or different materials. In the example shown in FIG. 7, the configuration and the material from which the clip 700 is made permits the arm to deflect elastically away from the helmet body 102 to permit the bar 110 to enter or leave the aperture 706. Alternatively, a mechanical pivot point may be provided between arm 318 and mounting portion 702 and a mechanical biasing structure provided to bias the arm towards the helmet body 102.

When the bar 110 approaches the aperture 706 from below, it will engage the ramped surface 708 to push the arm 704 away from the mounting portion 702, thereby to permit the bar 110 to enter the aperture 706. To release the bar 110, a user can pull the arm 704 away from the mounting portion 702 to open the aperture 706. An inward-facing. lip 712 may be provided at the lower end of the arm 704 to facilitate engagement of the arm 704 by the user. The clip 700 configuration and material selection is chosen so that the bar 110 is secured adequately in aperture 706 for its intended use, but also with sufficient compliance to permit the user to apply enough force such that the bar 110 can be pulled out of the aperture 706 directly without requiring the user to lift arm 704.

The mounting portion 702 includes a mounting surface 710 that engages with a corresponding surface in the helmet as discussed above with reference to push clip 200. The mounting portion 702 is, as before, bonded or affixed in another way into a recess defined the helmet body 102.

FIG. 8 illustrates a perspective view of the clip 700 of FIG. 7 mounted to a helmet body 102. As can be seen, in used with the face cage 104 in the down or closed position, the bar 110 is held in aperture 706, but a user can conveniently release the bar 110 by pulling the arm 704 away from the helmet body 102. As before, one clip 700 is provided on either side of the helmet, although more or less clips 700 are contemplated.

Changes and modifications may be made to the disclosed examples without departing from the scope of the present disclosure. These and other changes or modifications are intended to be included within the scope of the present disclosure, as expressed for example in the following claims.

What is claimed is:

1. A helmet comprising:

a helmet body; and a clip coupled to the helmet body, for retaining a helmet accessory, the clip comprising:

a first clip section partly defining an aperture into which a part of the helmet accessory can be received; and a second clip section located opposite the first clip section and having a first end and a second end, the first end partly defining the aperture into which the part of the helmet accessory can be received and the second end being coupled to the helmet body, the second clip section including a ramped surface that can be depressed to provide access to or from the aperture by the part of the helmet accessory.

2. The helmet of claim 1 further comprising a leash coupling the first clip section to the second clip section to limit outward movement of the second clip section.

3. The helmet of claim 1 wherein the first clip section and the second clip section are mounted. in a recess in the helmet body.

4. The helmet of claim 3 wherein the helmet body includes a biasing structure located in the recess in the helmet body to bias the second clip section away from the helmet body.

5. The helmet of claim 1 further comprising a face cage, the face cage being the helmet accessory and a bar of the face cage is the part of the helmet accessory that is received in the aperture defined by the first and second clip sections.

6. The helmet of claim 5 wherein the bar of the face cage depresses the second clip section when the face cage rotates into place on the helmet body.

7. The helmet of claim 1 wherein the first clip section includes a lip that extends towards the second clip section.

8. The helmet of claim 7 wherein the lip overlaps the ramped surface at the first end of the second clip section.

9. The helmet of claim 7 wherein the clip is formed at least partly of an elastomeric material that permits the part of the helmet accessory to be pulled out of the aperture between the first and second clip sections without the second clip section being depressed.

10. The helmet of claim 1 wherein the first clip section comprises a mounting portion and an arm, the arm including the ramped surface, wherein the arm is deflectable in use relative to the mounting portion to provide access to or from the aperture by the part of the helmet accessory.

11. The helmet of claim 10 wherein a notch is defined in the arm, or between the arm and the mounting portion of the second clip section, to facilitate deflection of the arm relative to the mounting portion.

12. A clip for retaining a helmet accessory on a helmet body, the clip comprising:

a first clip section partly defining an aperture into which a part of the helmet accessory can be received; and a second clip section opposite the first clip section and having a first end and a second end, the first end partly defining the aperture into which the part of the helmet accessory can be received and the second end being couplable to the helmet body, the second clip section including a ramped surface that can be depressed to provide access to or from the aperture by the part of the helmet accessory.

13. The clip of claim 12 further comprising a leash coupling the first clip section to the second clip section to limit outward movement of the second clip section relative to the helmet body.

14. The clip of claim 12 wherein the first clip section includes a lip that extends towards the second clip section.

15. The clip of claim 12 wherein the clip is formed at least partly of an elastomeric material that permits the part of the helmet accessory to be pulled out of the aperture between the first and second clip sections without the second clip section being depressed.

16. The clip of claim 12 wherein the first clip section comprises a mounting portion and an arm, the arm including the ramped surface, wherein the arm is deflectable in use relative to the mounting portion to provide access to or from the aperture by the part of the helmet accessory.

17. The clip of claim 16 wherein a notch is defined in the arm, or between the arm and the mounting portion of the second clip section, to facilitate deflection of the arm relative to the mounting portion.

18. A helmet comprising:

a helmet body; and a clip coupled to the helmet body, for retaining a helmet accessory, the clip comprising:

a first clip section partly defining an aperture into which a part of the helmet accessory can be received; and a second clip section located opposite the first clip section and having a first end and a second end, the first end partly defining the aperture into which the part of the helmet accessory can be received, the second clip section including a ramped surface that can be deflected by the part of the helmet accessory to provide access to the aperture by the part of the helmet accessory.

19. The helmet of claim 18 wherein the second clip section is coupled to the helmet body and the ramped surface is located on an outwardly-facing surface of the second clip section.

20. The helmet of claim 18 wherein the second clip section is coupled to the first clip section and the ramped surface is located on an inwardly-facing surface of the second clip section.

* * * * *